United States Patent [19]

Akesson

[11] Patent Number: 4,814,560

[45] Date of Patent: Mar. 21, 1989

[54] HIGH VOLTAGE CIRCUIT BREAKER

[75] Inventor: Ulf Åkesson, Ludvika, Sweden

[73] Assignee: ASEA Brown Boveri AB, Västerås, Sweden

[21] Appl. No.: 178,220

[22] Filed: Apr. 6, 1988

[30] Foreign Application Priority Data

Apr. 9, 1987 [SE] Sweden ..... 8701485

[51] Int. Cl.[4] ..... H01H 33/42

[52] U.S. Cl. ..... 200/148 F; 200/148 J

[58] Field of Search ..... 200/148 F, 148 J, 153 G, 200/153 H

[56] References Cited

U.S. PATENT DOCUMENTS

| | | | |
|---|---|---|---|
| 2,667,554 | 1/1954 | Shores | 200/148 F |
| 3,624,329 | 11/1971 | Fischer et al. | 200/148 F |
| 3,655,931 | 4/1972 | Circle | 200/148 J |
| 4,195,211 | 3/1980 | Aslan et al. | 200/148 F |

OTHER PUBLICATIONS

R. W. Alexander, "Synchronous Closing Control for Shunt Capacitors" in IEEE Transactions on Power Apparatus and Systems, vol. PAS-104, No. 9, Sep. 1985.

ASEA Journal, vol. 56, No. 3 (1983) pp. 16-21.

*Primary Examiner*—Robert S. Macon

*Attorney, Agent, or Firm*—Watson, Cole, Grindle & Watson

[57] ABSTRACT

In connection with synchronous closing or opening of three-pole circuit breakers, the desired time shift between the instants of contact make or contact break in the different phases can be achieved mechanically by a suitable choise of arms and links in the mechanical system interconnecting the contacts and the operating device. The necessary time difference between the instants of switching, with retained positions of open and closed contacts, can be achieved in mechanism with a toggle joint (4, 51) which is extended to a greater or smaller extent in the three poles.

10 Claims, 1 Drawing Sheet

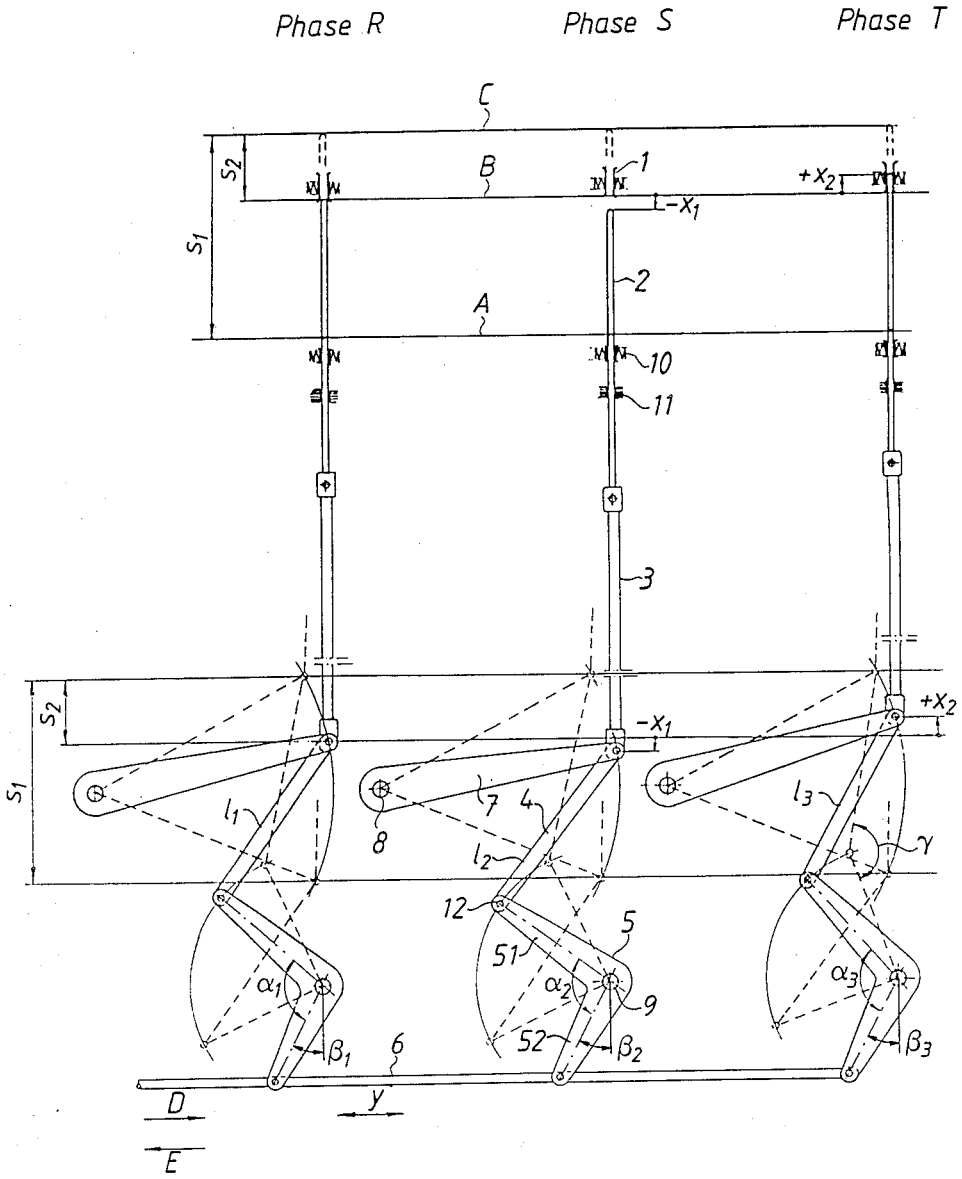
Phase R
Phase S
Phase T
C
B
A
1
2
3
10
11
$s_1$
$s_2$
$+x_2$
$-x_1$
$l_1$
$l_2$
$l_3$
4
5
6
7
8
9
12
51
52
$\alpha_1$
$\alpha_2$
$\alpha_3$
$\beta_1$
$\beta_2$
$\beta_3$
$\gamma$
y
D
E

HIGH VOLTAGE CIRCUIT BREAKER

TECHNICAL FIELD

The present invention relates to a three-pole high voltage circuit breaker, and more particularly to a device for synchronous closing and opening of such a breaker.

BACKGROUND ART

When certain electrical apparatus, such as transformers, reactors and shunt capacitors, are switched into a high voltage network by a circuit breaker which closes the circuit at an arbitrary point on the voltage wave, transient inrush currents with a large amplitude and rate of rise may occur. These currents may be detrimental to the apparatus and may cause mains interference.

To reduce the above-mentioned inrush currents, it is known to use a circuit breaker with closing (preinsertion) resistors, whereby the apparatus in question is first switched into the network via these resistors, which are thereafter short-circuited by the main contacts of the circuit breaker. However, this is a relatively expensive solution, which requires a complicated operating mechanism, which in turn involves reduced reliability.

It is further known to provide synchronous closing of apparatus of the above-mentioned kind with the aid of an electronic control device which gives a closing impulse to the operating device of the circuit breaker at such a time that the contact make in the three phases takes place at that point on the respective phase voltage wave which is most favourable in view of the closing transients. This means that transformers and reactors are switched in at the peak value of the respective phase voltage, whereas shunt capacitors are switched in at the passage through zero of the respective phase voltage. Equipment of this kind is described in IEEE Transactions on Power Apparatus and Systems, Vol. PAS-104, No. 9, September 1985 (R. W. Alexander: "Synchronous closing control for shunt capacitors"). In this equipment electronic tripping is provided in each individual phase. This requires a separate operating device for each breaker pole, i.e. altogether three operating devices.

SUMMARY OF THE INVENTION

The present invention relates to a three-pole high voltage circuit breaker with at least one breaking unit per pole, the breaking unit comprising a rod-shaped or tubular, axially movable contact which is connected via a link mechanism to an operating device common to all the poles. The link mechanism comprises a link, one end of which is connected at a toggle joint to an operating arm rotatable about an axis. The purpose of the invention is to provide a circuit breaker of the above-mentioned kind arranged for synchronous closing or opening, which in comparison with prior art devices is less expensive and more reliable. This is achieved according to the invention by a circuit breaker in which the angle at the toggle joint between the link and the arm in one breaking pole differs in magnitude from the corresponding angle in at least one of the other poles to such an extent that synchronous closing or opening in relation to current or voltage in the respective poles is obtained.

In synchronous closing or opening of a circuit breaker according to the present invention, an electric control device of a conventional kind can be used, which, as opposed to the control device described in the above-mentioned publication, only needs to give one tripping impulse to the operating device of the circuit breaker. The necessary time shift between the instants of contact make or contact break in different phases is brought about according to the invention by mechanical means by a suitable choice of arms and links in the mechanical system which links up contacts and operating devices. In 50 Hz systems with direct grounded and insulated neutral points, respectively, the following time differences are required between the instants of switching in different phases:

| | Phase R | Phase S | Phase T |
|---|---|---|---|
| With grounded neutral point | 0 | +3 ⅓ ms | −3 ⅓ ms |
| With insulated neutral point | 0 | +5 ms | +5 ms |

These differences can easily be accomplished by a mechanism with a toggle joint which is extended to a greater or smaller extent in the three poles.

With the mechanism proposed according to the invention, the following advantages, inter alia, are obtained:

The same length of contact travel in the three poles.

The same contact path in the three poles, which ensures a correct gas compression in, for example, an $SF_6$ puffer circuit breaker upon contact opening.

The same open position and closed position for the three contacts, which implies identical details in the three poles and their extinguishing chambers.

One single operating device can be used for synchronous switching of the three phases in relation to current or voltage.

DESCRIPTION OF THE PREFERRED EMBODIMENT

The invention will be described in greater detail with reference to an embodiment shown in the accompanying drawing.

The drawing shows contacts and link mechanisms in the three poles of a high voltage circuit breaker, which are each intended to be switched into a respective one of the phases R, S, T in a high voltage network. The circuit breaker may, for example, be an $SF_6$ circuit breaker of the kind described in ASEA Journal 1983, Vol. 56, No. 3, pp. 16–21.

Each breaking pole comprises a fixed contact 1 and a rod-shaped or tubular axially movable contact 2. The movable contact 2 is connected, via a rod-shaped operating insulator 3, a link 4 and a bell crank lever 5, to an operating rod 6 common to all the poles. An arm 7, which is rotatably journalled at a fixed bearing point 8, controls the lower end of the operating insulator 3. The bell crank lever 5 is rotatably journalled at a fixed bearing point 9. One of the arm parts 51 of this double arm is connected to the link 4, and the other arm part 52 thereof is connected to the operating rod 6. The angle between the arm parts 51 and 52 is designated $\alpha$.

The current path through the circuit breaker passes via the fixed contact 1, the movable contact 2 and a sliding contact 10. For straight guiding of the movable contact 2, a guide bearing 11 is provided.

The operating rod 6 is connected to an operating device capable of displacing the operating rod 6 by a certain length of travel y. Opening of the circuit breaker takes place by displacing the rod 6 to the right (direction of arrow D), and closing of the circuit breaker takes place by displacing the rod 6 to the left (direction of arrow E). The movable contact 2 thus moves between a closed position, when the contact tip lies on the line C, and an open position, when the contact tip lies on the line A. The position of the contact tip at the instants of contact make or contact break is shown in the drawing by the line B.

For synchronous closing of the circuit breaker, the operating device receives a closing impulse from an electronic control device which may be of a conventional design The operating rod 6 is then drawn to the closed position With knowledge of the closing time of the circuit breaker, the closing impulse can be chosen such that synchronous closing of the contacts in phases R, S and T is obtained Since the operating system in the three poles is mechanically connected through the operating rod 6, a distinct time difference upon contact make or contact break is always ensured. The time difference can be arbitrarily chosen by a suitable choice of the lengths, $\mathbf{1}_1$, $\mathbf{1}_2$ and $\mathbf{1}_3$ of the link 4 and the angles $\alpha_1$, $\alpha_2$ and $\alpha_3$ between the two arm parts 51 and 52 of the bell crank lever 5. The time difference is obtained by moving the joint 12 between the link 4 and the arm 5 more or less over toggle (angle $\gamma$). By choosing suitable combinations of the length of the link 4 and the angle $\alpha$ of the bell crank lever 5, the same length s of contact travel and the same contact path $s_2$ can be obtained in the three poles.

In the drawing, contacts and link mechanisms in the three poles are shown in the position in which contact make has just occurred in phase R. The movable contact 2 in phase T has then already passed the position of contact make by the length x , whereas the corresponding contact in phase S has to cover the distance $x_1$ before contact make occurs.

The double arm 5 need not be constructed in one piece but can suitably consist of two separate arm parts 51, 52, interconnected by splines. In this way, the double arms in the three poles may be constructed from identical arm parts, whereby the angle $\alpha$ between the arm parts can be easily changed in steps of, for example, 10°.

The invention is not limited to the embodiment shown but several variants are possible within the scope of the claims. For example, with the mechanism shown the contact movement can be influenced also by, for example, changing the position of the bearing points 8 and 9 changing the length of the guide arms 7 and the arm parts 51 and 52 rotating the angular position of the arms 5 (angle $\beta$) and 7.

The bell crank lever 5 need not necessarily be construced as shown in the drawing but may instead consist of, for example, a circular sector-shaped disc, to which the link 4 and the operating rod 6 are connected at different locations at the periphery of the disc.

Also other types of mechanisms with a partially unsymmetrical movement may produce a function similar to the one described above.

I claim:

1. A three-pole high voltage circuit breaker with at least one breaking unit per pole, said breaking unit comprising a rod-shaped or tubular, axially movable contact (2) which is connected via a link mechanism to an operating device common to all the poles, said link mechanism comprising a link (4), one end of which is connected at a toggle joint (12) to an operating arm (5) rotatable about an axis (9), wherein the angle ($\gamma$) at the toggle joint (12) between said link (4) and said arm (5) in one breaking pole differs in magnitude from the corresponding angle in at least one of the other poles to such an extent that synchronous closing or opening in relation to current or voltage in the respective poles is obtained.

2. High voltage circuit breaker according to claim 1, wherein said link (4) in one of the breaking poles has a length different from that of the corresponding link in at least one of the other poles.

3. High voltage circuit breaker according to claim 1, wherein said arm (5) consists of a bell crank lever with two arm parts (51, 52), the angle ($\alpha$) between the arm parts in one of the breaking poles having a magnitude different from that of the corresponding angle in at least one of the other poles.

4. High voltage circuit breaker according to claim 3, wherein the bell crank lever (5) comprises two separate arm parts (51, 52) fixed to each other by, for example, splines.

5. High voltage circuit breaker according to claim 3, wherein one of the arm parts (51) is connected to said link (4), the other arm part (52) being connected to an operating rod (6) common to all the poles.

6. High voltage circuit breaker according to claim 1, wherein the other end of said link (4) is articulately connected to a rod-shaped operating insulator (3) which is connected to the movable contact and which is articulately connected to a guide arm (7) rotatable about a second axis (8).

7. High voltage circuit breaker according to claim 6, wherein said guide arm (7) in one of the breaking poles has a length different from that of the corresponding guide arm in at least one of the other poles.

8. High voltage circuit breaker according to claim 1, wherein the axis of rotation (9) of said operating arm (5) in one of the breaking poles has a position different from that of the corresponding axis in at least one of the other poles.

9. High voltage circuit breaker according to claim 5, wherein the angle ($\beta$) between the second arm part (52) of the bell crank lever and the direction of movement of the movable contact (2) in one of the breaking poles has a magnitude different from that of the corresponding angle in at least one of the other poles.

10. High voltage circuit breaker according to claim 3, wherein at least one of the arm parts (51, 52) of the bell crank lever in one of the breaking poles has a length different from that of the corresponding arm part in at least one of the other poles.

* * * * *